United States Patent [19]

Henych et al.

[11] Patent Number: 4,462,455

[45] Date of Patent: Jul. 31, 1984

[54] PERMANENT MOLD WITH CORE PULLING DEVICE

[75] Inventors: Ivo Henych; Erwin Fischer, both of Schaffhausen, Switzerland

[73] Assignee: George Fischer Ltd., Switzerland

[21] Appl. No.: 243,957

[22] PCT Filed: Jul. 2, 1980

[86] PCT No.: PCT/CH80/00076

§ 371 Date: Mar. 5, 1981

§ 102(e) Date: Mar. 4, 1981

[87] PCT Pub. No.: WO81/00067

PCT Pub. Date: Jan. 22, 1981

[30] Foreign Application Priority Data

Jul. 5, 1979 [CH] Switzerland ..... 6289/79

[51] Int. Cl.[3] ..... B22C 9/10

[52] U.S. Cl. ..... 164/340; 164/137; 164/369

[58] Field of Search ..... 164/340, 366, 369, 397–399, 164/137, 370; 249/122, 124, 175, 177, 184

[56] References Cited

U.S. PATENT DOCUMENTS

| | | | |
|---|---|---|---|
| 818,413 | 4/1906 | Caldwell | 164/397 |
| 3,098,270 | 7/1963 | Bauer | 164/112 |
| 3,374,827 | 3/1968 | Schebler | 164/397 |
| 3,528,637 | 9/1970 | Bedford | 164/370 |

FOREIGN PATENT DOCUMENTS

| | | | |
|---|---|---|---|
| 0928617 | 6/1947 | France | 164/399 |
| 1597446 | 8/1970 | France | 164/397 |
| 48-24127 | 7/1973 | Japan | 164/137 |
| 775496 | 5/1957 | United Kingdom | 164/366 |

*Primary Examiner*—Kuang Y. Lin
*Assistant Examiner*—Richard K. Seidel
*Attorney, Agent, or Firm*—Roylance, Abrams, Berdo & Goodman

[57] ABSTRACT

A permanent mold is equipped with a core pulling device covered with a thin sand jacket, that can be peeled off, in order to produce unregular caves in the cast.

18 Claims, 2 Drawing Figures

PERMANENT MOLD WITH CORE PULLING DEVICE

SUMMARY OF THE INVENTION

The invention refers to a permanent mold with at least one core pulling device placed in the mold wall.

Pulling devices in permanent molds are known already and possess among others the advantage, that they are fixed exactly in the hollow space of the mold and can not be shifted. Corbelling cavities, that is cavities which increase toward the mold cavity, can, however, not be made. They are, however, very important as anchoring slots and similar in wearing parts consisting of hard casting materials, since such materials cannot be machined by normal tools. Such corbelling cavities up to now had to be made by means of sand cores, a procedure which is rather problematic. Due to the different heat conducting capabilities of the molding material and the metal, the solidification and the saturation are being disturbed. Also, an exact fixation (security against swimming-up) and positioning by means of core marks as well as the creation of gas cause difficulties.

Therefore, it is the object of the invention to propose a permanent mold, making it possible to produce corbelling cavities and threads economically by avoiding the disadvantages cited above.

This object is being realized by means of the teachings described in the first patent claim.

Advantageous embodiments of these teachings are described in the remaining claims.

The invention makes it possible to economically produce corbelling, e.g. hammer head bolt shaped (with or without interior thread) cavities in castings. The complicated, insecure and time consuming fixing is no longer necessary, so that time is being saved and the number of rejected products is being diminished and, therefore, the production economy is being improved. By means of the metal stud the form material (core sand) is being cooled. By a simple test procedure it is possible to reduce the thickness of the sand jacket to a very low value. In that way the cooling is being improved, and an increased cooling is possible by means of water supply. Thereby, a lower amount of gas is being produced, and the shrinking is not being disturbed after the core holding device in known manner (e.g. by means of toothed bar rack or hydraulic cylinders) has been retracted from the wall of the permanent mold. This is due to the fact that the resistive force acting against the shrinking, as compared to earlier procedures, has been reduced, so that the cast is allowed to decrease free from any resistive force. In any case the sand jacket can emerge in that it collapses and is being destroyed. The method can be applied to all casted materials, but particularly advantageously to iron alloys and basalt.

Figure 2:
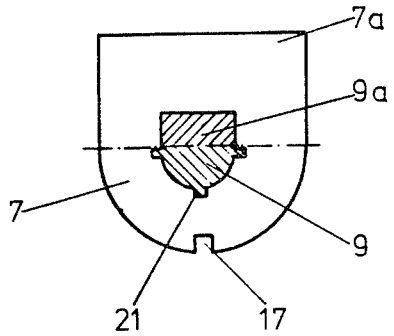
Figure 1:
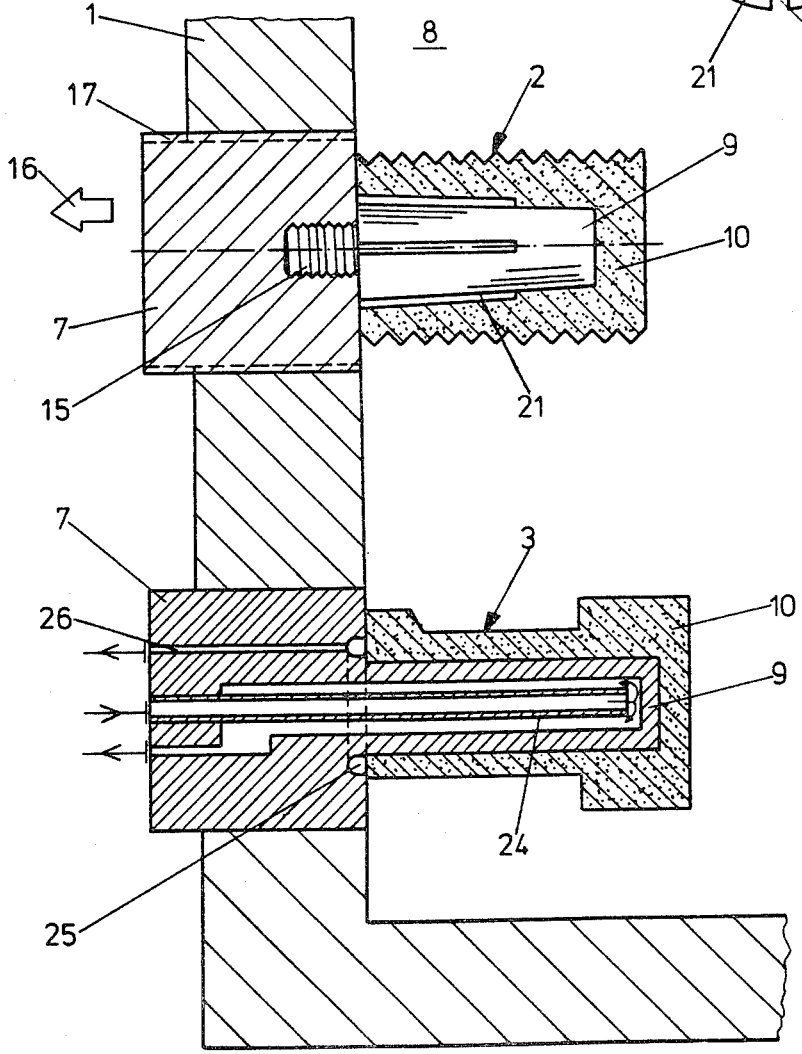

In the following an embodiment of the invention is being described with reference to the drawings, in which FIG. 1 shows a partial section through a permanent mold with two core pulling devices, and FIG. 2 shows parts of two sections of means for preventing a rotary movement of the core pulling device or sand jacket.

A permanent mold has a side wall 1, in which two sliding core pulling devices 2 and 3 are located, each comprising a core holding device, a stud 9 extending into the mold cavity 8, both of metal, advantageously of a copper-chrome-alloy (CuCr 1) and a jacket 10 of molding sand. Depending on the specific requirement the stud 9 can be screwed into the core holding device 7 by means of a screw stud 15 (core pulling device 2) or the stud 9 and the core holding device 7 can be formed in one piece (core pulling device 3). The jacket 10 is being pushed over the pushed-in stud 9 from the interior side of the mold.

Shortly after pouring of the melt, when the solidification has produced a crust on the wall 1 and around the sand jacket 10 of sufficient thickness, the core pulling devices 2 and 3 are operated in the direction of the arrow 16, so that the sand jacket remains in the cast. When the devices 2 and 3 are operated in the opposite direction it is important that the jacket 10 does not rotate. Therefore, the jacket 10 must be nonrotatable on the stud 9 and the holding device 7 must be nonrotatable movable in both directions. The holding device 7, therefore, has two longitudinal grooves 17 (pulling device 2). Also, a section deviating from a circle would be possible, as the example shown in FIG. 2, with a holding device 7*a* with square section.

The stud 9 is tapered toward its end from the holding device 7 in order to facilitate the loosening or strip-off of the jacket 10 when the stud 9 is being retracted. The stud 9 in the lower portion of FIG. 2 has a circular section provided with longitudinal ribs 21. It is also possible to provide the stud 9*a* with a square section, as shown in the upper portion of FIG. 2, in order to prevent rotation of the stud 9*a*. In this case longitudinal ribs are not necessary.

For bodies of rotation such provisions are not necessary.

To improve the fixation it is possible to use adhesives, e.g. waterglass or dextrin, in order to connect the jacket 10 with the stud 9.

The core pulling device 3 is provided with a seaparate water cooling. Water is being supplied through a central pipe 24 extending into the free end area of the stud 9. Also, the front end of the holding device 7, against where the sand jacket 10 is butting an annular notch 25 is provided, e.g. by milling, through which core gases can be set free through a pipe 26. These gases can also be sucked out of the pipe 26.

The core pulling devices can, furthermore, pull and push the core at an sloping angle with regard to the wall 1. It is also possible to produce a throughgoing cavity in the middle area of the corbelling cavity by moving two core pulling devices 3 from opposite walls toward each other, so that they touch each other slightly.

We claim:

1. An apparatus for forming a corbelled cavity in a casting, comprising:

a permanent mold shell having a wall with inner and outer surfaces defining an interior mold cavity;

at least one through bore in said wall opening on said outer surface of said wall and into said mold cavity;

a core holding device removably mounted in said bore, said core holding device having a portion extending radially inwardly from said outer surface with transverse cross-sectional dimensions not greater than corresponding transverse cross-sectional dimensions of said bore such that said core holding device is removable from said bore in a generally radially outward direction relative to said mold cavity;

a metal stud coupled to said core holding device and extending into said mold cavity, said stud having transverse cross-sectional dimensions not greater than said transverse cross-sectional dimensions of said core holding device such that said stud is removable through said bore with said core holding device; and a shaped jacket of molding material surrounding said stud, and extending into and terminating within said mold cavity, and said jacket having portions within said mold cavity of enlarged dimensions spaced from said core holding device;

whereby, said core holding device and said stud can be removed from said mold cavity and wall after solidification of molten casting material about said jacket, but prior to removal of the casting from said mold shell, leaving said jacket in the casting for subsequent removal to provide a corbelled cavity in the casting with interior dimensions greater than entry opening dimensions.

2. An apparatus according to claim 1 wherein said stud is noncircular in cross section.

3. An apparatus according to claim 2 wherein said core holding device includes means for preventing rotation relative to said wall.

4. An apparatus according to claim 2 wherein said stud has longitudinal ribs on its outer surface.

5. An apparatus according to claim 4 wherein said core holding device includes means for preventing rotation relative to said wall.

6. An apparatus according to claim 1 wherein said stud has longitudinal ribs on its outer surface.

7. An apparatus according to claim 6 wherein said core holding device includes means for preventing rotation relative to said wall.

8. An apparatus according to claim 1 wherein said core holding device includes means for preventing rotation relative to said wall.

9. An apparatus according to claim 1 wherein said jacket completely surrounds said stud in said mold cavity.

10. An apparatus according to claim 1 including an adhesive holding said jacket on said stud.

11. An apparatus according to claim 1 wherein said stud is tapered, decreasing in cross section toward the distal end thereof.

12. An apparatus according to claim 11 wherein said stud is formed from a copper-chromium alloy.

13. An apparatus according to claim 12 wherein said core holding device is formed from a copper-chromium alloy.

14. An apparatus according to claim 1 wherein said stud and core holding device are unitarily formed.

15. An apparatus according to claim 14 and further including means for water-cooling said stud.

16. An apparatus according to claim 15 and further including means defining a gas vent pipe extending from said jacket through said core holding device.

17. An apparatus according to claim 1 and further including means for water-cooling said stud.

18. An apparatus according to claim 17 and further including means defining a gas vent pipe extending from said jacket through said core holding device.

* * * * *